United States Patent [19]

Bishop

[11] 4,227,235

[45] Oct. 7, 1980

[54] STATIC NEUTRALIZER

[76] Inventor: Peter Bishop, 1 Varney Sq., Freeport, Me. 04032

[21] Appl. No.: 893,059

[22] Filed: Apr. 3, 1978

[51] Int. Cl.[2] ..... H01T 19/04

[52] U.S. Cl. ..... 361/230; 361/220; 361/222

[58] Field of Search ..... 361/212, 213, 214, 220, 361/222, 230

[56] References Cited

U.S. PATENT DOCUMENTS

| | | | |
|---|---|---|---|
| 1,680,310 | 8/1928 | Wehrle | 361/214 |
| 1,900,543 | 3/1933 | Cochrane | 361/214 |
| 1,903,840 | 4/1933 | Simons | 361/213 |
| 2,866,923 | 12/1958 | Herbert, Jr. | 361/230 |
| 3,120,626 | 2/1964 | Schweriner | 361/230 |
| 3,443,155 | 5/1969 | Schweriner | 361/230 |
| 3,725,736 | 4/1973 | Bishop | 361/230 |
| 3,908,127 | 9/1975 | Clark | 361/230 |
| 4,107,755 | 8/1978 | Kiefer | 361/220 |

OTHER PUBLICATIONS

*IBM Tech. Disc. Bull.,* vol. 20, No. 12, 5/78, "Corona Assembly," by Abbott et al., pp. 5124–5125.

*Primary Examiner*—J. D. Miller
*Assistant Examiner*—L. C. Schroeder

[57] ABSTRACT

A static electric neutralizer has a supporting bar in the form of a channel the width of which is about three times that of the cable which extends lengthwise thereof. Discharge devices are mounted on the cable as are supporting and spacing insulators, one between each two discharge devices and each connected to the channel to hold the cable in place with the discharge points equidistant from the side walls thereof and exposed between them.

16 Claims, 6 Drawing Figures

STATIC NEUTRALIZER

BACKGROUND REFERENCES

U.S. Pat. No. 1,680,310
U.S. Pat. No. 1,903,840
U.S. Pat. No. 3,120,626
U.S. Pat. No. 3,725,736

BACKGROUND OF THE INVENTION

Devices have long been employed to neutralize static electricity developed or developing during the operation of a machine.

Such devices include a bar within which there is an insulated conductor extending lengthwise thereof and provided with a series of discharge devices spaced along the cable with their discharge or emitter points exposed. With the conductor of the cable connected to a suitable high potential source and the bar grounded, the capacitatively coupled discharge points create an effective neutralizing field related to the voltage input and the structural features of the neutralizer.

While voltages used are substantial, the amperage of the potential is so low that it is unnecessary to ensure against manual contact with the discharge points. The voltage level is, however, a factor affecting the useful life of a neutralizer. As a consequence there is a need for static electric neutralizers that either provide a substantial increase in effectiveness with a given input or a given measure of effectiveness with a substantially lower input than is now possible thus to ensure a longer useful life of a neutralizer in meeting the requirements of a particular installation.

The Present Invention

The general objective of the present invention is to provide static electric neutralizers that are substantially more effective in use than previous neutralizers utilizing the same voltage, in the case of the present invention, less than 10,000 volts.

In accordance with the invention, the objective is attained with the neutralizer having a bar in the form of a U-shaped channel, an insulated conductor or cable extending lengthwise of the channel on which are mounted discharge devices having relatively long sleeve portions capacitatively coupled to the conductor and supporting and spacing insulators between dead end and cable end insulators with a discharge device between each two insulators and in practice insulators are held by the channel to position the cable spaced equally from the walls of the channel and with the discharge points exposed in the channel equidistant from the side walls thereof. The ratio between the diameter of the insulated conductor and the width of the channel is within the approximate range of from 2.5:1 to 3.5:1. Such a neutralizer operates with increased effectiveness in the neighborhood of twenty percent over ones in which the sleeve portions are not fully exposed or ones in which only the discharge or emitter points are exposed.

Another objective of the invention is to enable the discharge devices to be of the type consisting of a plurality of turns of a wire which provide a sleeve-like portion dimensioned to receive the cable within it with the ends disposed as discharge points, an objective attained with the insulators provided with end notches which are in alignment midway between the side walls of the channel when the insulators are positioned therein and which hold the discharge points so that they, too, are in alignment centrally of the channel.

Another objective of the invention is to provide a neutralizer of the above type that is readily assembled, an objective attained with the channel side walls formed with retaining ribs, the insulators shaped and dimensioned to be slidable within the channel and retained by the wall ribs and the cable end insulator consisting of lengthwise sections each so shaped and dimensioned that when assembled about the cable and within the channel, the cable is held against moving lengthwise relative thereto. In practice, the cable end insulator has an inner socket dimensioned to receive the cable and an outer socket is dimensioned to receive the cable and the end of a length of tubing shielding the outer portion of the cable between the channel and the connector by which the conductor of the cable may be coupled to the high potential input source.

Other objectives of the invention will be apparent from the following specification and appended claims.

BRIEF DESCRIPTION OF THE DRAWINGS

The accompanying drawings illustrate a preferred embodiment of the invention of which

THE PREFERRED EMBODIMENT OF THE INVENTION

Figures 1, 2, 3, 4, 5, 6:
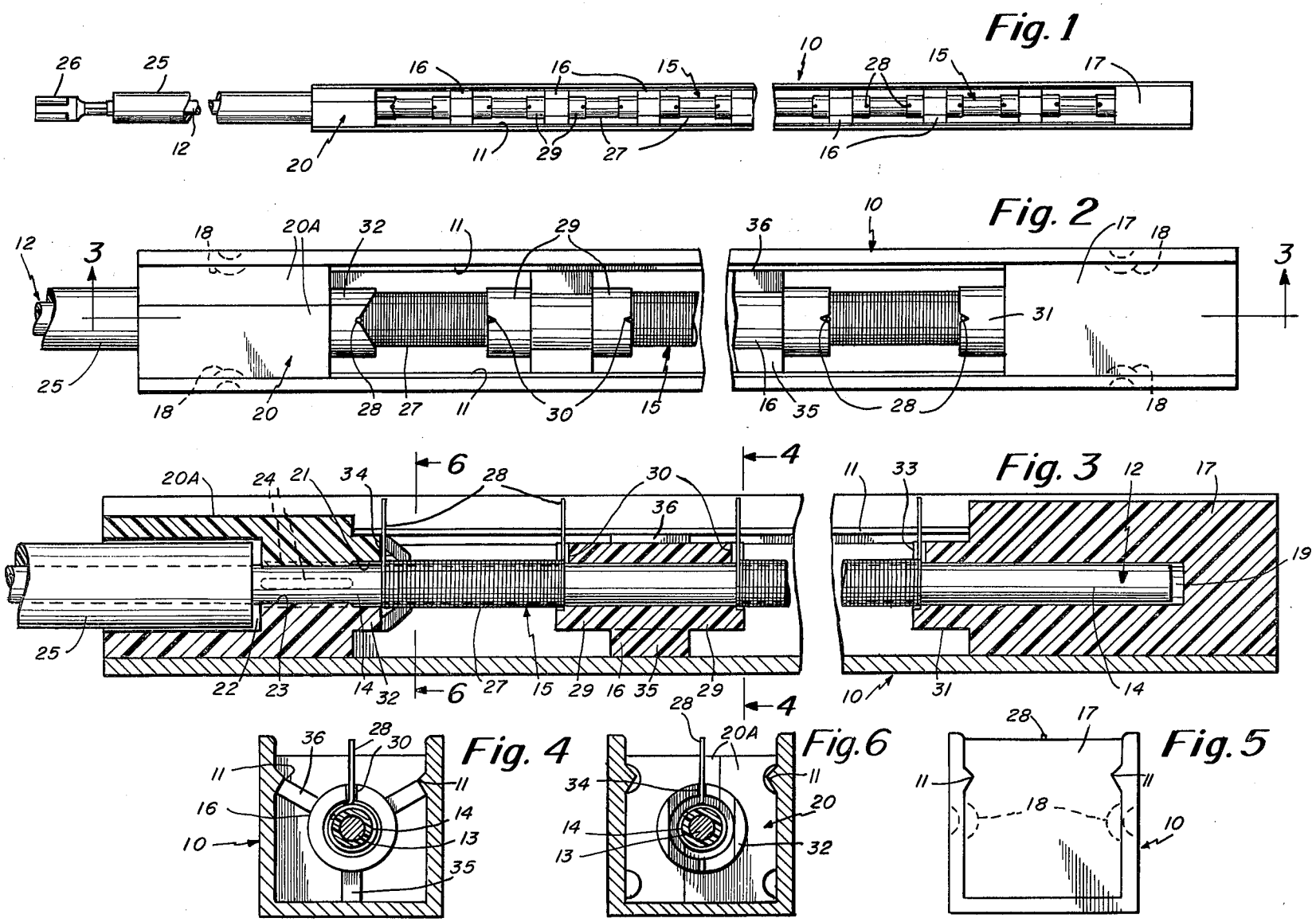
FIG. 1 is an elevational view thereof showing the channel with the discharge devices and their emitter points exposed.
FIG. 2 is a like view on a substantial increase in scale.
FIG. 3 is a section taken approximately along the indicated line 3—3 of FIG. 2.
FIG. 4 is a section taken approximately along the indicated line 4—4 of FIG. 3.
FIG. 5 is a view of the neutralizer as seen from the end in which the dead end insulator is exposed.
FIG. 6 is a section taken approximately along the indicated line 7—7 of FIG. 6.

The static electric neutralizer illustrated by the drawings consists of a bar 10 in the form of a channel of a length appropriate for a particular installation and, in practice, an aluminum extrusion. The channel 10 has an internal angular rib 11 extending lengthwise of each of its side walls adjacent the mouth of the channel, see FIGS. 4 and 5.

An insulated conductor or cable, generally indicated at 12, the conductor and insulation of which are indicated at 13 and 14, respectively, extends lengthwise of the channel 10 and extends through a series of discharge devices generally indicated at 15 and a series of insulators 16, one insulator between each two discharge devices. A dead end insulator 17 of a cross sectional size and shape to be slidably entered in an end of the channel 10 and retained therein by its ribs 11 is provided with a centrally located socket 19 which receives one end of the cable 12. The insulator 17 is held against movement lengthwise of the channel 10 as by indentations 18 in the channel side walls. A cable and insulator, generally indicated at 20 is of a cross sectional size and shape to be slidably entered in the other end of the channel 10 and retained therein by the ribs 11 and is also anchored as at 18 to the channel side walls.

The insulator 20, see FIGS. 6 and 7, consists of two identical, lengthwise sections 20A to be assembled about the cable 12 with the faces that are then in mutual contact so recessed that on such assembly, inner and outer sockets 21 and 22 are established that are connected by a passage 23. The diameter of the passage 23 is equal to the outside diameter of the cable 12 and has lengthwise ridges 24 which so penetrate or compress the cable insulation 14, when the sections 20A are assembled about the cable 12 to complete the insulator 20 and entered into the channel 10, as to grip and anchor the cable against accidentally being moved relative thereto. The outwardly opening socket 22 is dimensioned to receive one end of an insulating tubing 25 through which the cable 12 extends with its outer end provided with a connector 26 by which the conductor 13 may be connected to a suitable, high potential source, not shown.

Turning now to the discharge devices 15, it will be seen that each is shown as of the type consisting of a series of turns of wire to provide a sleeve portion 27 through which the cable 12 extends with ends disposed to provide emitter or discharge points 28. The diameter of the wire from which the discharge devices are formed is desirably in the neighborhood of 0.012 of an inch. Each insulator 16 is approximately the same length as the sleeve portions 27 of the discharge devices and has cylindrical ends 29 each having a notch 30 to receive and hold a discharge point 28, the notches 30 being in alignment thus to ensure the alignment of the points 28. The insulators 17 and 20 include cylindrical portions 31 and 32, respectively provided with like point-holding notches 33 and 34, respectively, and these are also positioned to ensure the alignment of the points 28 held therein with all the other discharge points 28. It will be noted from FIG. 6 that each section 20A is approximately L-shaped. When the sections 20A are assembled about the cable 12, the planes established by the faces that are in mutual contact are on opposite sides of but parallel to the plane established by the notches 34.

Each insulator 16 is shaped and dimensioned to be slidably entered in the channel 10 and retained therein by the ribs 11 thus to hold the cable 12. To that end, the central section of each insulator 16 is shown as having a series of three arms, one arm 35 to engage the bottom wall of the channel 10 and two arms 36 each to engage the inner surface of one of the ribs 11 and thus hold the cable 12 and the sleeve portions of the discharge devices 15 parallel to the walls of the channel 10 and equidistant from each of its walls.

While the dimensions of the channel 10 are in part dependent on the voltage to be used, the most effective relationship between the diameter of the cable and the width of the channel is within the approximate range of from 2.5:1 to 3.5:1 and the voltage used in less than 10,000 volts, preferably in the 3–8,000 volt range. The width of the channels are within the 5–16 mm range, the higher the voltage, the greater the cross sectional area of the channel. By way of example, when the voltage is to be 3,000 volts, the cable width is close to 5 mm, when the voltage is to be 5,000 volts, the channel width is about 9.5 mm and when 8,000 volts are to be used, the channel width is about 15.6 mm. The length of the discharge device is in practice such as to space the emitter points 28 about 10 mm apart.

I claim:

1. A static electric neutralizer comprising a bar in the form of a U-shaped channel of a predetermined length, a cable extending lengthwise thereof, the ratio between the width of the channel and the diameter of the cables within the approximate range of from 2.5:1 to 3.5:1, a series of discharge devices each including a portion of substantial length mounted on the insulation of the cable and capacitatively coupled to the conductor thereof and at least one emitter point, a series of supporting and spacing insulators within said channel through which the cable extends, one insulator between each two discharge devices against which proximate ends of the devices are seated, a dead end insulator at one end of the bar receiving an end of said cable and against which one end of the proximate device is seated, a cable end insulator at the other end of the channel through which the cable extends and against which the proximate device is seated, said dead end and cable end insulator anchored to said channel, means connecting at least some of said spacing insulators to said channel to hold said cable in a predetermined position out of contact with said channel and equidistant from the side walls thereof, and said insulators and devices including interengaged portions by which the seated ends of the devices are so held as to position and maintain all of said emitter points aligned and disposed outwardly and spaced equally from said side walls leaving said devices between said portions bare and visually exposed through the channel opening.

2. The static electric neutralizer of claim 1 in which the relationship between the width of the channel and the outside diameter of the cable is approximately 3:1.

3. The static electric neutralizer of claim 2 in which the width of the channel is approximately 9.5 mm and the neutralizer is to be used with the conductor connected to a source of approximately 5,000 volts.

4. The static electric neutralizer of claim 2 in which the width of the channel is approximately 15.6 mm and the neutralizer is to be used with the conductor connected to a source of approximately 8,000 volts.

5. The static electric neutralizer of claim 2 in which the width of the channel is approximately 5.5 mm and the neutralizer is to be used with the conductor connected to a source of approximately 3,000 volts.

6. The static electric neutralizer of claim 1 in which each spacing insulator is of approximately the same length as the discharge devices.

7. The static electric neutralizer of claim 1 in which each discharge device comprises a plurality of turns of a wire providing a sleeve-like portion fitting the conductor and vertically extending end portions constituting emitter points and the ends of all insulators that are within the channel have notches in which the emitter points are seated.

8. The static electric neutralizer of claim 7 in which the side walls of the channel include ribs extending lengthwise of their inner surfaces and the insulators are shaped and dimensioned to slidably fit the channel and include portions in engagement with the ribs thus to be retained in the channel.

9. The static electric neutralizer of claim 8 in which each spacing insulator includes end portions and an intermediate portion, each intermediate portion including spacing arms, one engageable with the bottom wall of the channel and one for each side wall and engageable with the inner surface of the rib thereof.

10. The static electric neutralizer of claim 1 and means connecting the cable to the cable end insulator to prevent accidental relative movement therebetween and means locking the cable end insulator to the channel.

11. The static electric neutralizer of claim 10 and means locking the dead end insulator to the channel.

12. The static electric neutralizer of claim 1 in which the cable end insulator includes two lengthwise sections adapted to be assembled in face-to-face contact, each section so recessed that when assembled inwardly and outwardly disposed sockets and a connecting passage are provided, the connecting passage dimensioned to accommodate the cable and so compress the insulation thereto as to anchor the cable thereto when the sections are assembled about the cable and inserted in the channel.

13. The static electric neutralizer of claim 12 and means locking each section of the cable end insulator to the channel.

14. The static electric neutralizer of claim 12 in which the outwardly disposed socket is dimensioned to receive an insulating tubing through which the outer end of the cable extends.

15. The static electric neutralizer of claim 12 in which each section is approximately L-shaped in cross section and includes inner end portions which on assembly provide the inwardly opening socket, each inner end portion having a notch to receive a discharge point and so located that the surfaces of the sections in mutual contact are offset but parallel to a plane defined by the notches of the sections.

16. The static electric neutralizer of claim 1 in which the emitter point of each discharge device is at an end thereof and each insulator against which one of said ends is seated has a socket entered thereby and a notch through which the emitter point extends.

* * * * *